United States Patent [19]

Staab et al.

[11] Patent Number: 4,639,303

[45] Date of Patent: Jan. 27, 1987

[54] ELECTROLYSIS APPARATUS WITH HORIZONTALLY DISPOSED ELECTRODES

[75] Inventors: Rudolf Staab; Dieter Bergner; Kurt Hannesen, all of Kelkheim, Fed. Rep. of Germany

[73] Assignee: Hoechst Aktiengesellschaft, Fed. Rep. of Germany

[21] Appl. No.: 790,825

[22] Filed: Oct. 24, 1985

[30] Foreign Application Priority Data

Oct. 26, 1984 [DE] Fed. Rep. of Germany ..... 3439265

[51] Int. Cl.[4] ..... C25B 9/00; C25B 11/10; C25B 13/00

[52] U.S. Cl. ..... 204/258; 204/263; 204/290 F; 204/290 R

[58] Field of Search ..... 204/253–258, 204/252, 290 F, 290 R, 284, 283, 263–266, 128

[56] References Cited

U.S. PATENT DOCUMENTS 1,907,818 5/1933 Hunter ..... 204/256 X
3,770,611 11/1973 Barnabe ..... 204/256
3,976,550 8/1976 De Nora et al. ..... 204/256 X
3,976,556 8/1976 De Nora ..... 204/266 X
4,350,575 9/1982 Porta et al. ..... 204/263 X

*Primary Examiner*—Donald R. Valentine
*Attorney, Agent, or Firm*—Connolly and Hutz

[57] ABSTRACT

In this electrolysis apparatus for the preparation of chlorine from aqueous alkali halide solutions, which comprises at least one electrolytic cell, the anode and gas diffusion cathode are disposed horizontally and separated from each other by a partition in a housing consisting of two half shells and are connected mechanically and in an electrically conducting manner by means of their edges to the respective half shells. In addition, the cathode is connected in a liquid-tight manner to its half shell and is supported by a current supply and distribution device. The partition is clamped between a circumferential seal between the edges of the half shell and a frame and is supported on a spacer which rests on the cathode and is held by the frame. The frame contains an inlet and outlet for the catholyte.

3 Claims, 1 Drawing Figure

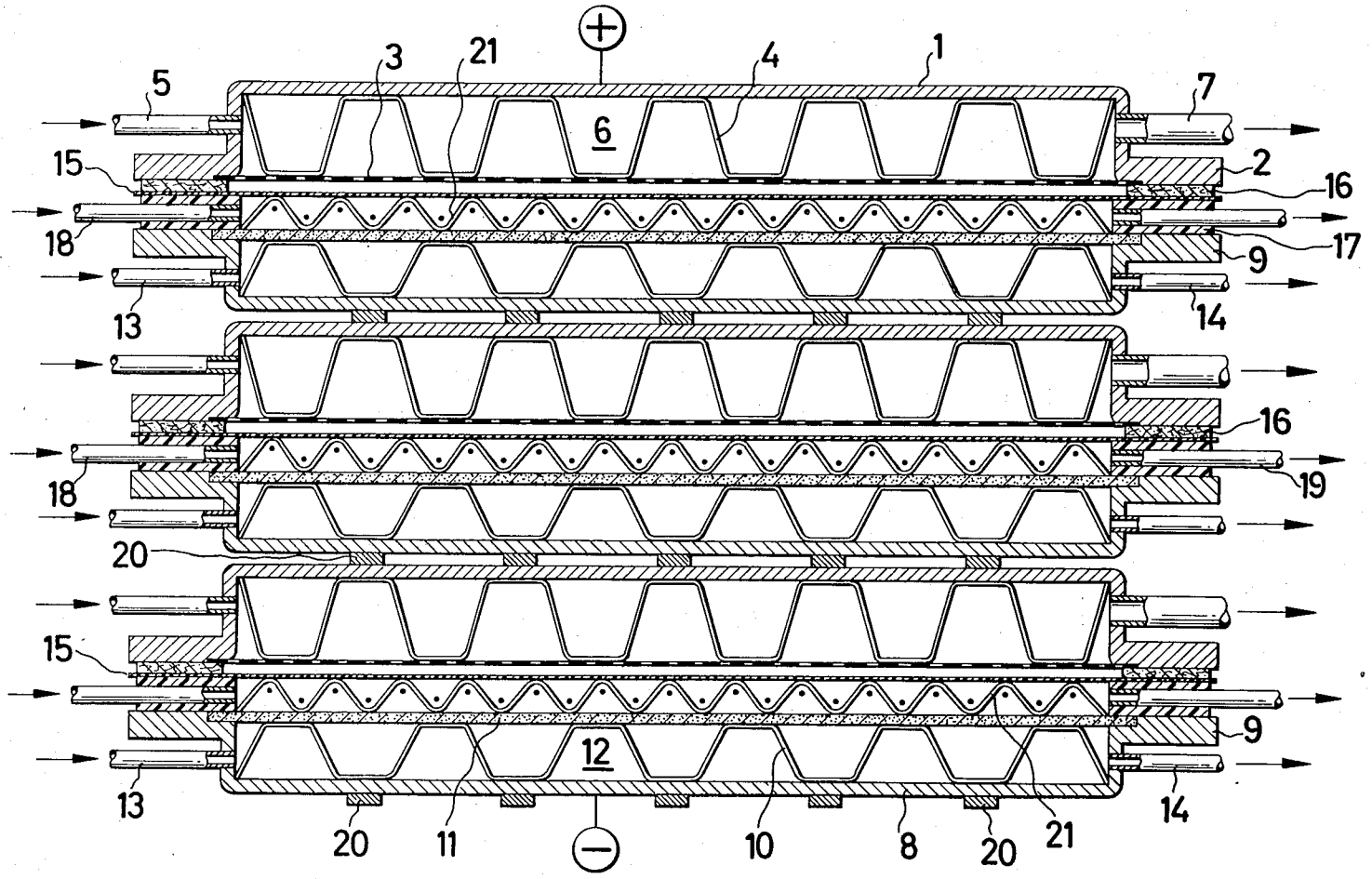
1
2
3
4
5
6
7
8
9
10
11
12
13
14
15
16
17
18
19
20
21
+
−

ELECTROLYSIS APPARATUS WITH HORIZONTALLY DISPOSED ELECTRODES

The invention relates to an electrolysis apparatus for the preparation of chlorine from aqueous alkali halide solutions which comprises at least one electrolytic cell whose anode and gas diffusion cathode are disposed horizontally and separated from each other by a partition in a housing consisting of two half shells and are connected by means of their edges mechanically and in an electrically conducting manner with the half shells, the housing being provided with devices for feeding in the electrolytic starting materials and for removing the products of electrolysis.

When electrolytic cells are operated with vertically disposed gas diffusion cathodes there is the risk that due to the hydrostatic pressure of the lye the oxygen-consuming cathodes become permeable to electrolyte at the lower end and premeable to gas at the upper end. This effect becomes all the more noticeable the greater the overall height of a cell. A further difficulty in the operation of electrolytic cells with gas diffusion cathodes consists in the supplying of current to the oxygen-consuming cathode. Since the electrode must be rendered water-repellent with a plastic material, eg. polytetrafluoroethylene, to avoid "drowning", it is not possible to weld such cathodes into the cathode space. The water-repellent agent would burn off in these conditions. At the same time leakages would be produced in the cathode so that the latter would become permeable to electrolyte and gas. However, it is precisely the impermeability of the gas diffusion cathode which is a decisive prerequisite for the operation of electrolytic baths with such electrodes. In practice this means that contact must be made to the gas diffusion cathodes by pressing on a current supply conductor. In these circumstances, especially in the case of planar current supply conductors, high contact resistances occur. The result of this is that it is virtually impossible to operate large electrolytic cells with an active surface of 1 $m^2$ and over with gas diffusion cathodes.

It was therefore the object to develop an electrolytic cell which permits a planar current supply conductor and consequently a bipolar switching mode for the electrolytic bath to be provided in the case of a large electrode area, the individual electrolytic cells consisting of as few simple and cheap components as possible and the gas diffusion cathode being capable of being optimally supplied with electrolyte and oxygen, so that neither electrolyte no gas passes through the cathode.

The present invention achieves this object in that the gas diffusion cathode is connected in a liquid-tight manner with its half shell and is supported by a current supply and distribution device, the partition is clamped between a circumferential seal between the edges of the half shells and a frame disposed parallel thereto and rests on the cathode side on a spacer which is supported on the cathode and is held by the frame and the frame contains an inlet and outlet for the catholyte.

Titanium which is activated with an oxide or mixed oxide of metals of subgroup 8 of the periodic system is suitable as the anode material. The diffusion cathode may consist of a current collector consisting of nickel mesh which is coated with a porous, colloidal silver catalyst, which is deposited on polytetrafluoroethylene, and has a hydrophilic coating on the lye side.

The advantage of the arrangement according to the invention is to be seen in the fact that an extremely thin film of lye in the cathode space is adequate. This results in a low hydrostatic lye pressure at which only a very small, usually negligible, quantity of lye passes through the cathode. Since, therefore, no lye has to be driven out of the gas space, the cell can be operated with the stoichiometric quantity of oxygen. Moreover, because of the low lye pressure a low gas pressure is also sufficient to establish the three-phase gas/electrolyte/-catalyst boundary surface within the cathode. On the anode side the chlorine bubble effect is considerably reduced by the rapid separation of chlorine and anolyte. In the horizontal arrangement in contrast to the vertical arrangement of the electrodes, bending of the relatively flexible gas diffusion cathodes and the establishment of different electrode spacings at different points (for example, as a result of bulging of the cathode due to the lye pressure), which would lead to an uneven current distribution, are prevented by means of the spacer.

The invention will now be explained in more detail with reference to the FIGURE. This shows an electrolysis apparatus consisting of three electrolytic cells with gas diffusion cathodes 11, which are completely independent of each other and are connected to each other in an electrically conducting manner by means of contact points of contact strips 20. The advantage of this embodiment lies in the ease of servicing of the construction if damaged points occur in a cell. By reducing the clamping pressure the damaged cell can be removed from the cell assembly and immediately after the clamping pressure has been re-established, the electrolysis can be resumed using the remaining cells.

The half shells 1 and 8, whose edges are constructed as flanges 2 and 9, support the anode 3 and the gas diffusion cathode 11. The anode shell 1 may consist of titanium metal or a titanium alloy. The anode 3, which may likewise consist of titanium which is activated with a noble-metal oxide, is connected in an electrically conducting manner with the anode half shell 1 by means of an anode current conductor 4 which may be constucted, for example, in the form of a titanium corrugated strip. The anode space 6 is supplied with electrolyte, for example saturated sodium chloride solution, via an inlet 5. The chlorine formed and the depleted brine and removed via the tube 7. Standard steel, high grade steel or nickel and even titanium metal may be used for the cathode half shell 8; the latter in particular because no hydrogen is produced in the electrolytic cell and consequently the $H_2$ embrittlement of the titanium cannot occur. The cathode half shell 8 accommodates the cathode current conductor 10 as the current supply and distribution device which may be shaped in the form of a corrugated strip and consists of the same material as the cathode half shell. The cathode current conductor 10 supports the gas diffusion cathode 11 and connects the latter in an electrically conducting manner to the cathode half shell 8. The gas diffusion cathode 11 consists preferably of a metal-based electrocatalyst such as is described, for example, in German Patent Application P 33 32 566.9 (corresponds to U.S. Ser. No. 648,014, now U.S. Pat. No. 4,563,261) since an electrode of this type can also be welded or soldered in a simple manner to the cathode current conductor. The gas diffusion cathode is connected at the outer edge to the cathode half shell 8 also by soldering, welding or bonding by means of an electrically conducting adhesive and simultaneously sealed so that the gas space 12 is formed beneath the cathode. An oxygen-containing gas, for example elementary oxygen, air or air enriched in oxygen is fed into this space via an inlet 13. The excess oxygen or air depleted in oxygen is removed via the tube 14. Any condensate accruing can also be removed via this tube 14.

On the flange 9 of the cathode half shell 8 there is a circumferential frame 17 consisting of a lye-resistant material which is provided with an inlet pipe 18 for the weak lye and an outlet pipe 19 for the strong lye. The preferred material is polytetrafluoroethylene since this also provides the sealing with respect to the cathode half shell. The lye space is defined by the frame 17, the partition 15 and the cathode 11. This expediently accommodates a spacer 21 of a lye-resistant plastic material which establishes a constant distance between the gas diffusion cathode 11 and the partition 15, for example a cation exchange membrane. The partition 15 is sealed with respect to the anode shell 1 by means of a seal 16. The half shells may be connected to each other by means of screws on the flanges threaded through bushes of electrically insulating material (not shown). This makes the cell particularly easy to service and maintain. It is, however, also possible to stack the individual parts of the cell on top of each other and press them together in the manner of a filterpress. To make a better transfer of current from cell to cell possible, the outsides of the two half shell walls or even only one half shell wall may be provided ith contact points or contact strips 20 of an electrically conducting material. Finally, the cells assembled into an electrolysis apparatus are pressed together by means of tie rods or other compressive devices (not depicted). The current supply conductors are marked "plus" and "minus". The anode 3 may rest on the partition 15.

An electrolytic cell according to the above description was put into operation with a gas diffusion cathode based on colloidal silver and a titanium anode in a manner such that the titanium anode was above the gas diffusion cathode. The active cathode area, which was flooded with elementary oxygen, was 0.2 $m^2$. The cell was fitted with a cation exchange membrane of the type Nafion ® 90209. For a current density of 3 $kA/m^2$ the electrolytic cell operates with a cell voltage of 2.17 V, 1550 kWh of electrical energy being consumed per tonne of NaOH. The cell is operated with the stoichiometric quantity of oxygen at 90° C.; 33% by weight sodium hydroxide solution is produced.

We claim:

1. Electrolysis apparatus for preparing chlorine from aqueous alkali halide solutions comprising at least one electrolytic cell having an anode and a gas diffusion cathode both of which are horizontally disposed, a partition separating the anode and cathode from each other, a housing consisting of two half shells surrounding the anode and cathode, a mechanical and electrical connection between the anode and one of the half shells and a similar connection between the cathode and the other half shell, devices for feeding electrolytic starting materials into the housing and for removing products of electrolysis therefrom, a liquid-tight connection between the cathode and its half shell, a current supply and distribution device supporting the cathode in its half shell, a spacer extending between the cathode and the partition for supporting the partition, means holding the partition between the half shells, seal means sealing the partition from the anode shell, a circumferential frame between the shells connected to hold the spacer in its position, and inlet and outlet means in the frame for feeding and removing catholyte.

2. Electrolysis apparatus as in claim 1 wherein the anode is a titanium anode activated with an oxide or mixed oxide of metals of subgroup 8 of the periodic system.

3. Electrolysis apparatus as in claim 1 wherein the gas diffusion cathode consists of a current collector of nickel mesh coated with porous, colloidal silver catalyst deposited on polytetrafluoroethylene, and a hydrophilic covering coating on the side cathode next to the spacer.

* * * * *